US007810282B2

(12) United States Patent
Oxley

(10) Patent No.: US 7,810,282 B2
(45) Date of Patent: Oct. 12, 2010

(54) BELT-DRIVEN RACK GEAR POWER SLIDING DOOR

(75) Inventor: Peter Lance Oxley, Mount Albert (CA)

(73) Assignee: Magna Closures Inc., Newmarket (CA)

( * ) Notice: Subject to any disclaimer, the term of this patent is extended or adjusted under 35 U.S.C. 154(b) by 21 days.

(21) Appl. No.: 11/860,714

(22) Filed: Sep. 25, 2007

(65) Prior Publication Data

US 2008/0072497 A1 Mar. 27, 2008

Related U.S. Application Data

(60) Provisional application No. 60/846,956, filed on Sep. 25, 2006.

(51) Int. Cl.
*E05F 15/06* (2006.01)

(52) U.S. Cl. ..... 49/362; 49/358; 49/360

(58) Field of Classification Search ..... 49/413, 49/362, 139, 140, 358, 360
See application file for complete search history.

(56) References Cited

U.S. PATENT DOCUMENTS

| | | | | | |
|---|---|---|---|---|---|
| 3,496,794 | A | * | 2/1970 | Forichon | 74/440 |
| 4,612,729 | A | | 9/1986 | Sato | |
| 4,640,050 | A | | 2/1987 | Yamagishi et al. | |
| 4,744,172 | A | * | 5/1988 | Miyauchi | 49/349 |
| 4,887,390 | A | | 12/1989 | Boyko et al. | |
| 4,932,715 | A | | 6/1990 | Kramer | |
| 5,004,280 | A | | 4/1991 | Schap | |
| 5,025,894 | A | * | 6/1991 | Yamasaki | 187/266 |
| 5,083,472 | A | | 1/1992 | Kang | |
| 5,168,666 | A | * | 12/1992 | Koura et al. | 49/360 |
| 5,203,112 | A | | 4/1993 | Yamagishi et al. | |
| 5,316,365 | A | | 5/1994 | Kuhlman et al. | |
| 5,377,448 | A | | 1/1995 | Boyd et al. | |
| 5,434,487 | A | | 7/1995 | Long et al. | |
| 5,536,061 | A | | 7/1996 | Moore et al. | |
| 5,606,826 | A | | 3/1997 | Calhoun | |
| 5,644,869 | A | | 7/1997 | Buchanan, Jr. | |
| 5,833,301 | A | | 11/1998 | Watanabe et al. | |
| 5,992,919 | A | | 11/1999 | Menke | |
| RE36,428 | E | * | 12/1999 | Moore et al. | 296/155 |
| 6,025,685 | A | * | 2/2000 | Parsadayan | 318/471 |

(Continued)

FOREIGN PATENT DOCUMENTS

| | | |
|---|---|---|
| EP | 1405978 | 4/2004 |

(Continued)

*Primary Examiner*—Gregory J. Strimbu
(74) *Attorney, Agent, or Firm*—Clarkhill P.L.C.

(57) ABSTRACT

A power door drive system for moving a sliding side door on a vehicle body having an aperture between an open position substantially clear of the aperture and a closed position substantially covering the aperture. A guide track having channel and rack portions is mounted to the vehicle body adjacent the aperture. The rack portion includes a plurality of rack teeth. A hinge member is adapted for mounting to the side door and includes a plurality of guide rollers for rollingly engaging the channel portion of the guide track. A power drive mechanism mounted to the hinge member includes a reversible motor for producing a drive torque, a pinion gear having a plurality of drive teeth meshingly engaging the rack teeth, and an endless belt for transferring the drive torque from the motor to the pinion gear thereby driving the sliding door between the open and closed position.

17 Claims, 7 Drawing Sheets

U.S. PATENT DOCUMENTS

| | | | | |
|---|---|---|---|---|
| 6,079,767 | A | 6/2000 | Faubert et al. | |
| 6,081,088 | A | 6/2000 | Ishihara et al. | |
| 6,125,583 | A | 10/2000 | Murray et al. | |
| 6,125,586 | A | 10/2000 | Buscher | |
| 6,152,519 | A | 11/2000 | Blank et al. | |
| 6,155,630 | A | 12/2000 | Fukumoto et al. | |
| 6,174,020 | B1 | 1/2001 | Knettle et al. | |
| 6,250,013 | B1 * | 6/2001 | Apprich | 49/362 |
| 6,256,930 | B1 | 7/2001 | Faubert et al. | |
| 6,276,743 | B1 | 8/2001 | Jyawook et al. | |
| 6,341,448 | B1 | 1/2002 | Murray et al. | |
| 6,367,864 | B2 | 4/2002 | Rogers, Jr. et al. | |
| 6,390,516 | B1 | 5/2002 | Kobayashi | |
| 6,390,535 | B1 | 5/2002 | Chapman | |
| 6,435,600 | B1 * | 8/2002 | Long et al. | 296/155 |
| 6,460,295 | B1 | 10/2002 | Johnson et al. | |
| 6,464,287 | B2 | 10/2002 | Rogers, Jr. et al. | |
| 6,481,783 | B1 | 11/2002 | Rogers, Jr. et al. | |
| 6,553,719 | B1 | 4/2003 | Stone et al. | |
| 6,729,071 | B1 | 5/2004 | Kawanobe et al. | |
| 6,854,212 | B2 * | 2/2005 | Engelgau et al. | 49/360 |
| 2002/0043818 | A1 | 4/2002 | Fukumoto et al. | |

FOREIGN PATENT DOCUMENTS

| | | |
|---|---|---|
| EP | 1548221 | 6/2005 |

* cited by examiner

BELT-DRIVEN RACK GEAR POWER SLIDING DOOR

This application claims the benefit of U.S. Provisional Application No. 60/846,956, filed Sep. 25, 2006.

BACKGROUND OF THE INVENTION

1. Field of the Invention

The invention relates to a power sliding door. More particularly, the invention relates to a power drive mechanism mounted to a hinge member for opening and closing a power sliding door of an automotive vehicle.

2. Description of Related Art

In various types of automotive vehicles, including minivans, delivery vans, and the like, it has become common practice to provide a vehicle body with relatively large side openings that are located immediately behind front doors and which are opened and closed with a sliding side door. The sliding side door is typically mounted with upper and lower hinge members to horizontal tracks on the vehicle body for guided sliding movement between a closed position flush with the vehicle body, closing the side opening, and an open position located outward of and alongside the vehicle body rearward of the side opening. The sliding side door may be operated manually or with a power operated system to which the present invention is directed.

Examples of conventional power operated systems for automatically opening and closing the sliding side door are described in U.S. Pat. Nos. 6,481,783; 6,464,287; 6,435,600; 6,256,930; 6,079,767; 5,833,301; 5,644,869; 5,536,061; 5,434,487; 5,203,112; 5,168,666; and 4,612,729. Commonly assigned U.S. Pat. No. 6,435,600, which is hereby incorporated by reference as if fully set forth herein, discloses a power sliding door system for an automotive vehicle 10. A sliding door 36 is operated by a power drive mechanism 124 that is mounted to the door 36 and includes a drive motor 200 mounted within the door, a lower drive unit 204 having a rotatable pinion gear 208 mounted to a hinge member 120 fixed to the door 36, and a flexible driveshaft 202 coupling the drive motor 200 and pinion gear 208 for transmitting drive torque therebetween. The pinion gear 208 meshingly engages a rack 38 mounted along a floor 30 of a vehicle body 14 to open and close the door 36.

While the arrangement disclosed in U.S. Pat. No. 6,435,600 provides certain improvements in the pertinent art, several drawbacks have been noted. These drawbacks include, for example: (1) interference between drop glass in the door 36 and the drive motor 200; (2) excessive labor to install; (3) high drive torque losses in the curved flexible driveshaft 202 resulting in high manual efforts; (4) high cost of the flexible driveshaft 202 and lower drive unit 204 which includes a gear train consisting of bevel gears and ball bearings; and (5) excessive noise from the lower drive unit 204.

Another type of power sliding door system utilizing a rack 17 and a pinion gear 23 to effect the movement of a sliding side door 1 is disclosed in U.S. Pat. No. 4,612,729. This type of arrangement, however, requires considerable accommodating space and modifications to a vehicle body since a motor 18 and gear housing 19 are disposed within a floor of the vehicle body and move along the rack 17 together with the door 1.

U.S. Pat. No. 5,536,601 discloses another type of power sliding door system. The system utilizes a power drive mechanism 28 that is mounted to a sliding door 22 and extends through a side opening in the door 22. The drive mechanism 28 includes a reversible electric motor 62 that drives a friction wheel 38 which is spring biased to forcibly engage a guide track 40 located beneath a vehicle floor 14 and attached to a vehicle body 10. The friction wheel 38 rides along the guide track 40 to open and close the door 22 and additionally guides and stabilizes its sliding movement. Several drawbacks are associated with this arrangement, such as, the appearance of the door 22, and the cost, reliability and performance of the drive mechanism 28.

Various other types of power sliding door systems utilize a cable, chain, or belt to open and close the sliding side door. For example, U.S. Pat. No. 5,168,666 discloses a door drive device which includes a guide rail 2 in a vehicle body 1 defining a path along which a side door 3 moves. An endless belt 22 extends around first 17 and second 20 pulleys which are arranged at spaced positions within the vehicle body 1. A bracket 23 is provided for connecting a portion of the endless belt 22 to the side door 3 and a reversible electric motor 11 drives the first pulley 17 thereby moving the side door 3 between opened and closed positions. These types of power sliding door systems are complicated, include numerous parts, and require considerable accommodating space within a floor of the vehicle body 1 since the belt 22, first 17 and second 20 pulleys, and motor 11 are all disposed therein.

Consequently, it is desirable to provide a simple, inexpensive, quiet, compact, and easily installed power door drive system for opening and closing a power sliding door of an automotive vehicle.

SUMMARY OF THE INVENTION

According to one aspect of the invention, a power door drive system is provided for moving a sliding side door on a vehicle body having an aperture between an open position wherein the side door substantially clears the aperture and a closed position wherein the side door substantially covers the aperture. The power door drive system includes a guide track mounted to and extending along the vehicle body adjacent the aperture. The guide track includes a channel portion and a rack portion which has a plurality of rack teeth disposed therealong. A hinge member has a first end adapted for mounting to the side door and a second end. The second end has a plurality of guide rollers for rollingly engaging the channel portion of the guide track. A power drive mechanism is mounted to the hinge member. The power drive mechanism includes a reversible motor that is operable for producing a drive torque, a pinion gear which has a plurality of drive teeth meshingly engaging the plurality of rack teeth, and an endless belt for transferring the drive torque from the motor to the pinion gear thereby driving the sliding door between the open and closed positions.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
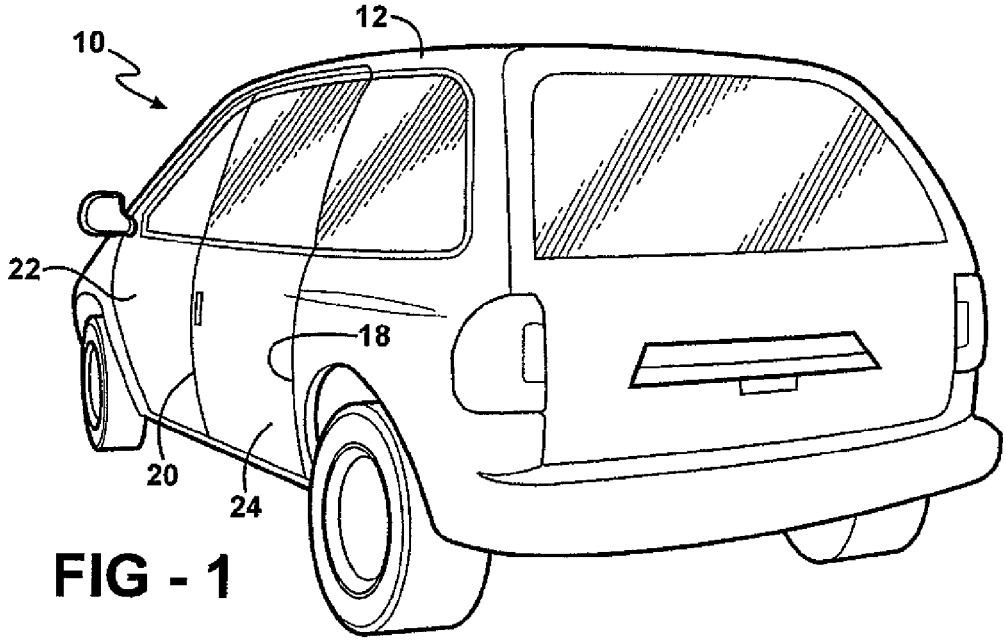
FIG. 1 is a perspective view of an automotive vehicle equipped with a power door drive system for opening and closing a sliding side door according to the invention.
Figure 2:
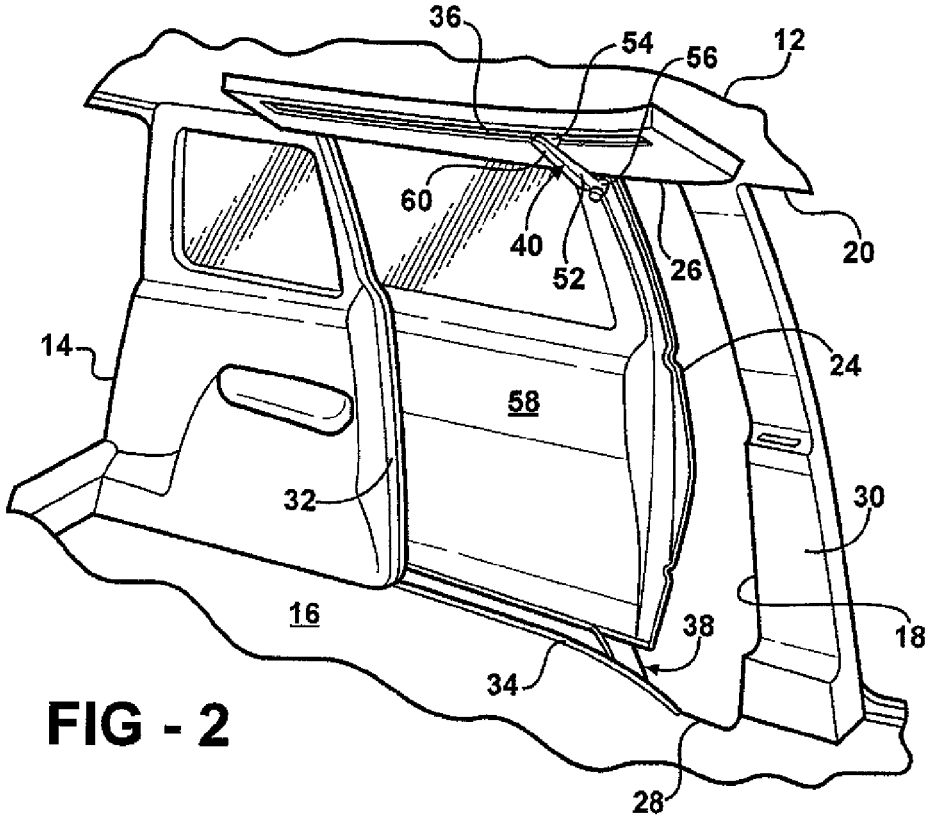
FIG. 2 is a fragmentary, perspective view of an interior passenger compartment of the vehicle illustrated in FIG. 1.

Referring to FIGS. 1 and 2, an automotive vehicle of a minivan type is generally shown at 10 and includes a vehicle body 12. The body 12 defines an interior passenger compartment 14 with a floor 16, and a rear side opening 18 positioned on a left side of the vehicle 10 immediately rearward of a front side opening 20. The front 20 and rear 18 side openings provide access to respective front and rear areas of the passenger compartment 14. The front side opening 20 is opened and closed by a front door 22 that is mounted in a conventional manner on the vehicle body 12 for pivotal movement about a vertical axis at a forward edge of the door 22. The rear side opening 18 is substantially larger than the front side opening 20, and is opened and closed by a sliding side door 24. Although not shown in the Figures, it will be understood that the vehicle body 12 may be equipped with a substantially identical sliding side door on a right side thereof. Additionally, it will be appreciated by those skilled in the art that the teachings of the present invention will have applicability to other vehicle types and closure styles.

The rear side opening 18 is defined by an upper edge 26, a lower edge 28, a first body pillar 30, and a second body pillar 32. A lower guide track 34 is disposed in the floor 16 adjacent the lower edge 28 and extends therealong. Similarly, a conventional upper guide track 36 is disposed adjacent the upper edge 26 and extends therealong. The side door 24 is slidably mounted to the lower guide track 34 with a lower mounting assembly, generally indicated at 38, and to the upper guide track 36 with an upper mounting assembly, generally indicated at 40, for movement between an open position and a closed position. In the open position, the side door 24 substantially clears the rear side opening 18 and is disposed rearward thereof. In the closed position, the side door 24 substantially covers the rear side opening 18.

Figure 3:
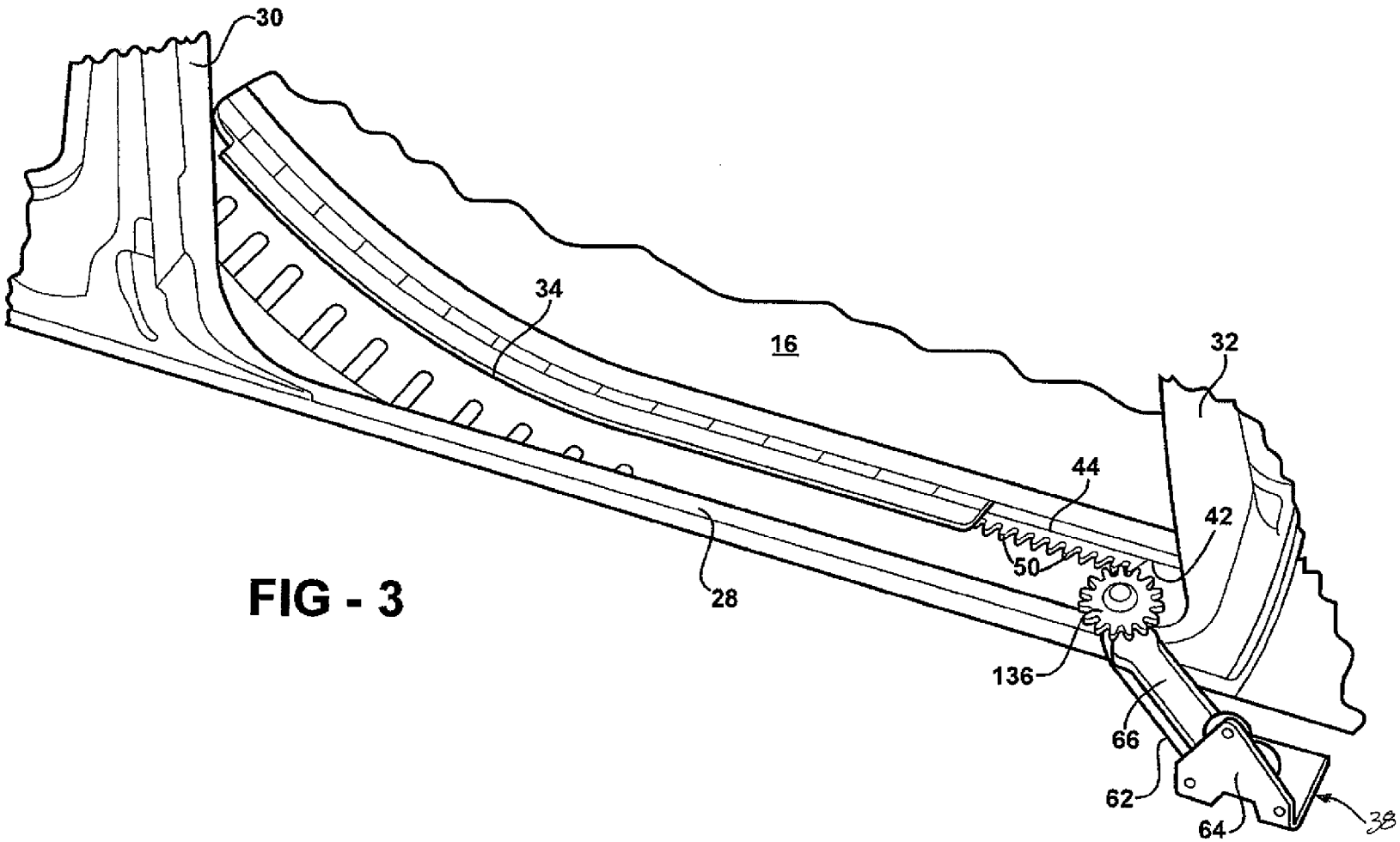
FIG. 3 is a fragmentary, perspective view of a floor of the vehicle illustrated in FIG. 1 having a guide track with the sliding side door in an open position.
Figure 4:
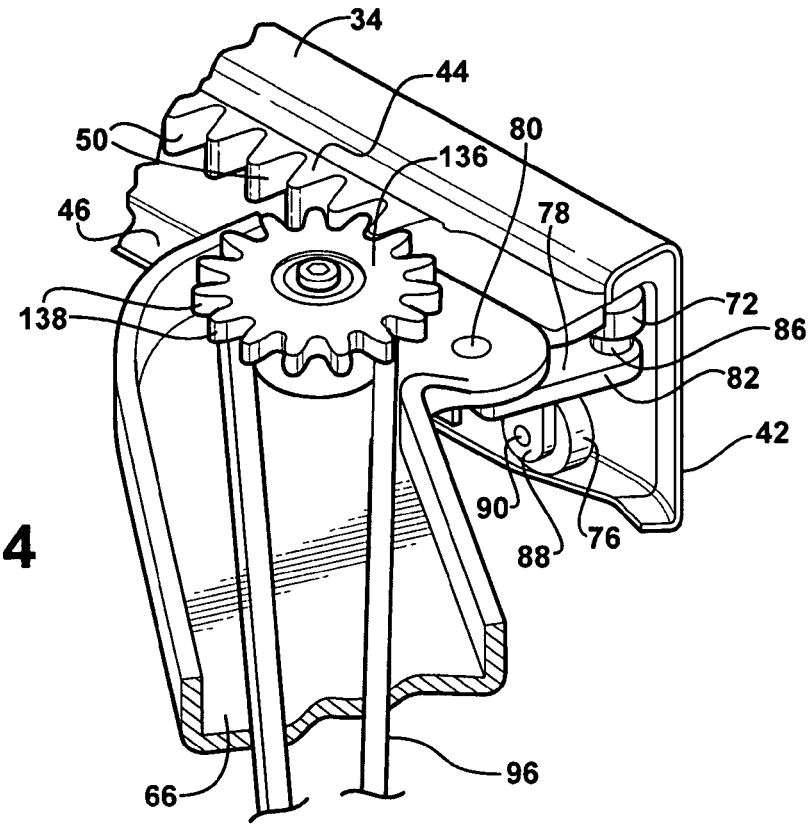
FIG. 4 is a fragmentary, top perspective view of a lower mounting assembly coupled to the guide track.
Figure 5:
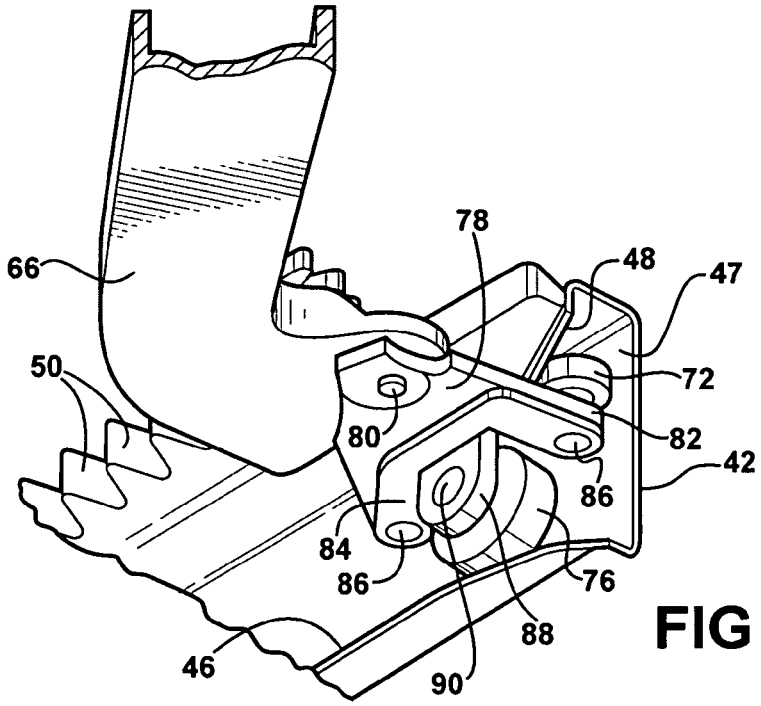
FIG. 5 is a fragmentary, bottom perspective view of the lower mounting assembly coupled to the guide track.

Referring to FIG. 3, the lower guide track 34 is shown to curve inward relative to the passenger compartment 14 of the vehicle body 12 as it approaches the first body pillar 30. Referring to FIGS. 4 and 5, the lower guide track 34 includes a channel portion 42 and a rack portion 44. The channel portion 42 includes a vertical guide surface 46, shown in FIG. 4, and opposing first 47 and second 48 horizontal guide surfaces, shown in FIG. 5. The rack portion 44 includes a plurality of horizontal, outward facing rack teeth 50 disposed therealong. The upper guide track 36 also is shown to curve inward relative to the passenger compartment 14 of the vehicle body 12 as it approaches the first body pillar 30, as shown in FIG. 2.

Referring to FIG. 2, the upper mounting assembly 40 is mounted to an upper forward corner of the side door 24. The upper mounting assembly 40 includes an upper hinge member 52 and an upper guide roller 54. A first end 56 of the upper hinge member 52 is fixedly secured to an interior side 58 of the side door 24, and the upper guide roller 54 is rotatably coupled to a second end 60 of the upper hinge member 52. The upper guide roller 54 is adapted for rolling engagement with the upper guide track 36.

Figure 6:
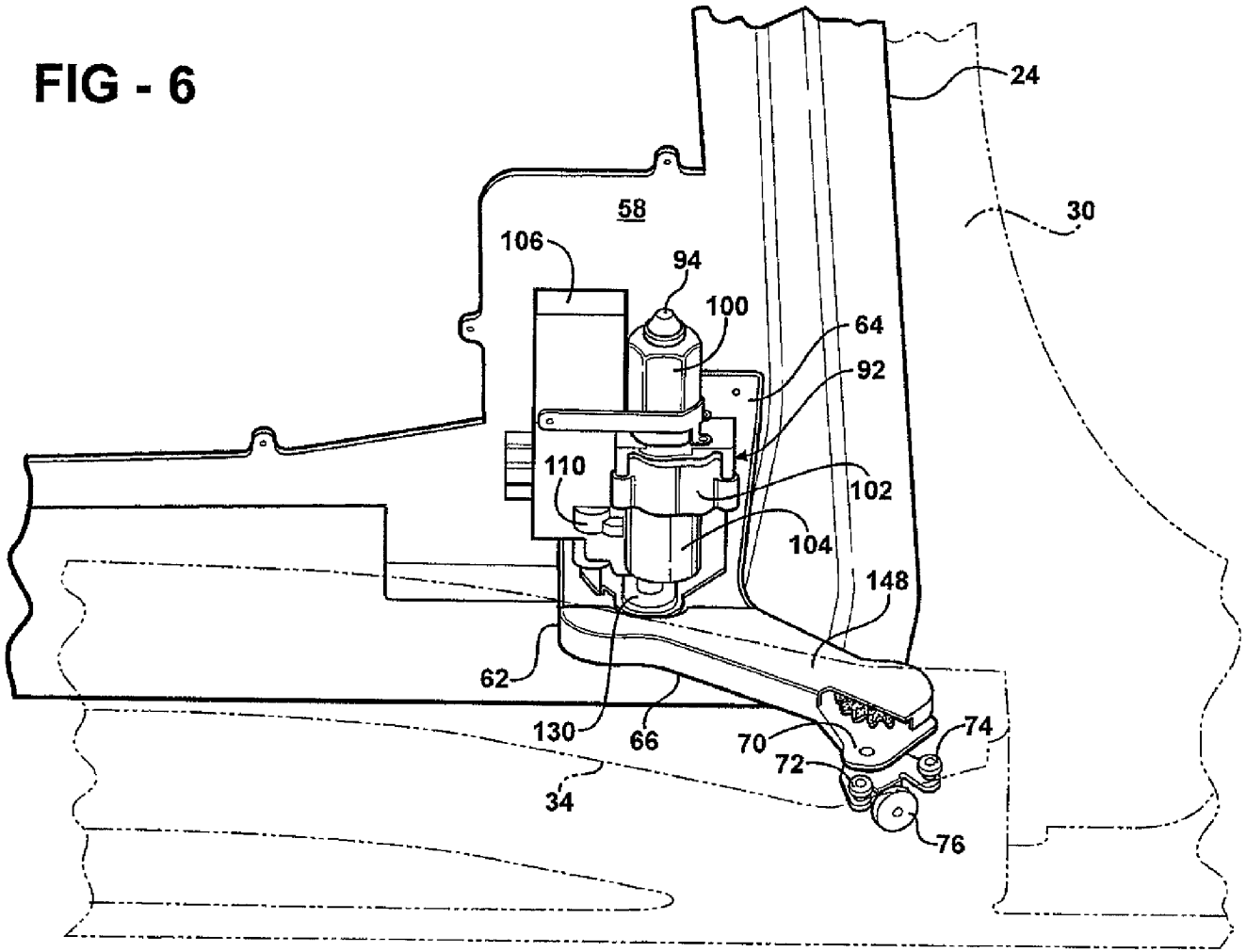
FIG. 6 is a perspective view of the lower mounting assembly mounted to an interior side of the sliding side door showing a hinge-mounted power drive mechanism.
Figure 7:
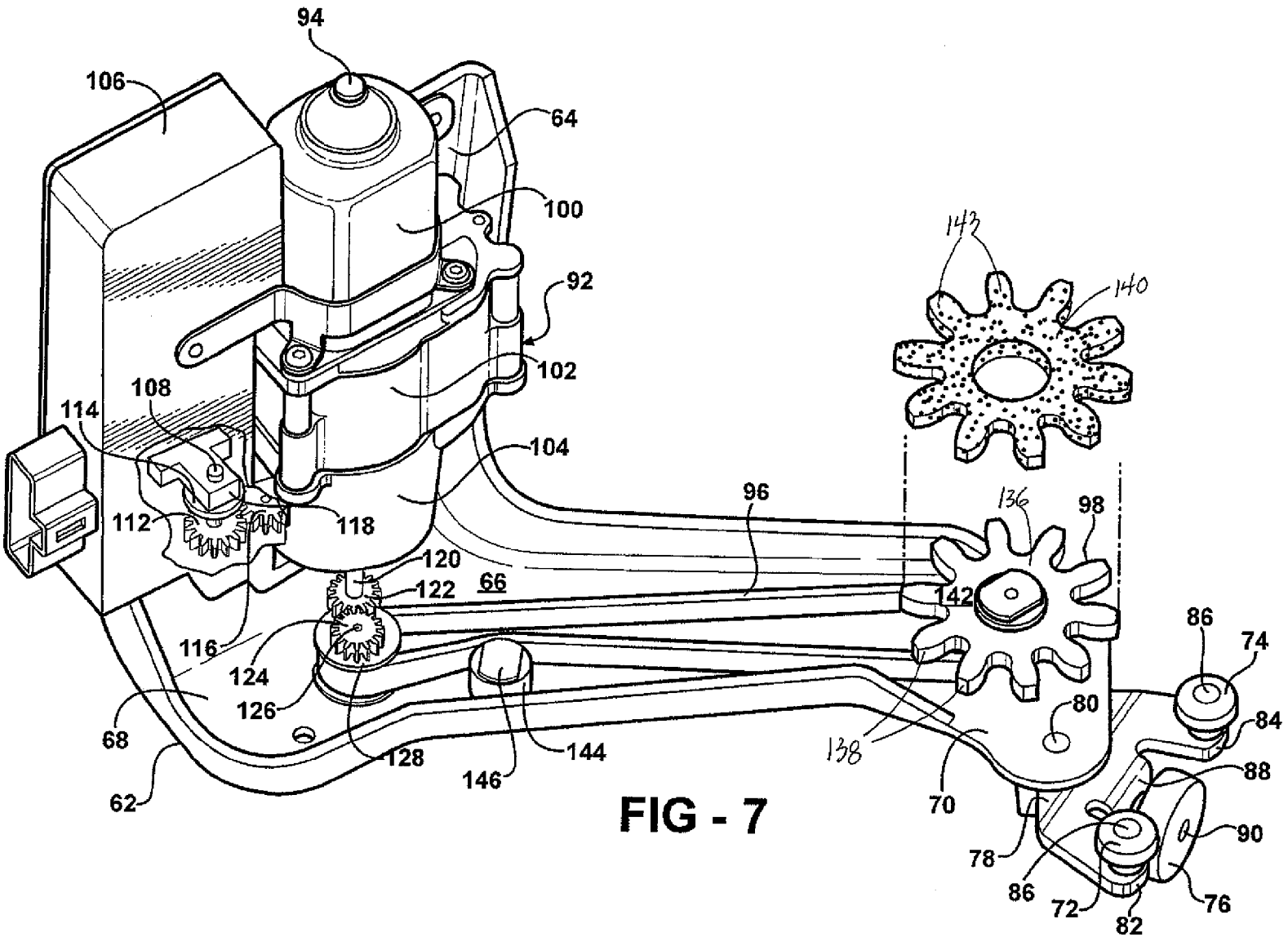
FIG. 7 is a perspective view of the hinge-mounted power drive mechanism with a belt cover removed and a dampener shadow gear exploded away for purposes of illustration.

The lower mounting assembly 38 is mounted to a lower forward corner of the side door 24. The lower mounting assembly 38 includes a lower hinge member 62 having a first vertical portion 64 and a second horizontal portion 66, as shown in FIGS. 3 and 7. The vertical portion 64 is adapted to be fixedly secured to the interior side 58 of the side door 24, as shown in FIG. 6. Referring to FIG. 7, the horizontal portion 66 extends between a proximal end 68 adjacent the vertical portion 64 and an opposite distal end 70. The lower mounting assembly 38 also includes first 72 and second 74 lateral guide rollers, a vertical guide roller 76, and an articulating bracket 78. The articulating bracket 78 is pivotally coupled to the distal end 70 of the horizontal portion 66 by a pivot pin 80. The articulating bracket 78 is generally U-shaped, with each end 82, 84 having a cylindrical aperture (not shown) for receiving a vertically extending roller pin 86, each one of which journally supports one of the first 72 and second 74 horizontal guide rollers. A tongue 88 extends in a perpendicular direction downward between ends 82, 84 and includes a cylindrical aperture (not shown) for receiving a horizontally extending roller pin 90 which journally supports the vertical guide roller 76.

Referring to FIGS. 4 and 5, the lower mounting assembly 38 is adapted for cooperation with the lower guide track 34 wherein the vertical guide roller 76 rollingly engages the vertical guide surface 46, and the first 72 and second 74 horizontal guide rollers rollingly engage the first 47 and second 48 horizontal guide surfaces. As such, cooperation between the guide rollers 76, 72, 74 and their respective guide surfaces 46, 47, 48 ensures proper vertical and horizontal alignment of the lower mounting assembly 38 to the rack portion 44 of the lower guide track 34. Since the articulating bracket 78 is pivotally coupled to the lower hinge member 62, the guide rollers 76, 72, 74 are capable of traversing the curved length of the lower guide track 34.

Referring to FIG. 6, the side door 24 is shown to include a power drive mechanism, generally indicated at 92, operatively mounted to the lower hinge member 62. In the preferred embodiment, the power drive mechanism 92 includes a power unit 94, an endless flexible belt 96, and a drive unit 98, as shown in FIG. 7. More specifically, the power unit 94 is fixedly secured to the vertical portion 64 of the lower hinge member 62 and includes a reversible motor 100, a gearbox 102, and a clutch 104.

Referring to FIG. 7, an electronic control unit (hereinafter referred to as an "ECU") 106 for controlling motor speed is mounted adjacent the vertical portion 64 of the lower hinge member 62. The ECU 106 is coupled electrically to the motor 100 and clutch 104 by push-in connectors (not shown). A vertically extending shaft 108 is mounted within an ECU housing 110 for rotatably supporting a first spur gear 112 and an encoder wheel 114. The first spur gear 112 meshingly engages an idler gear 116 driven by the clutch 104 such that rotational movement within the clutch 104 rotates the idler gear 116, which in turn causes the first spur gear 112 to rotate. Rotational movement of the first spur gear 112 causes the shaft 108, and therefore the encoder wheel 114 to rotate. An optical sensor 118 mounted to the ECU 106 adjacent the encoder wheel 114 is adapted to read slots (not shown) in the encoder wheel 114 as it rotates to determine the position of the side door 24 relative to the lower guide track 34 and the velocity at which the side door 24 is traveling.

Figure 8:
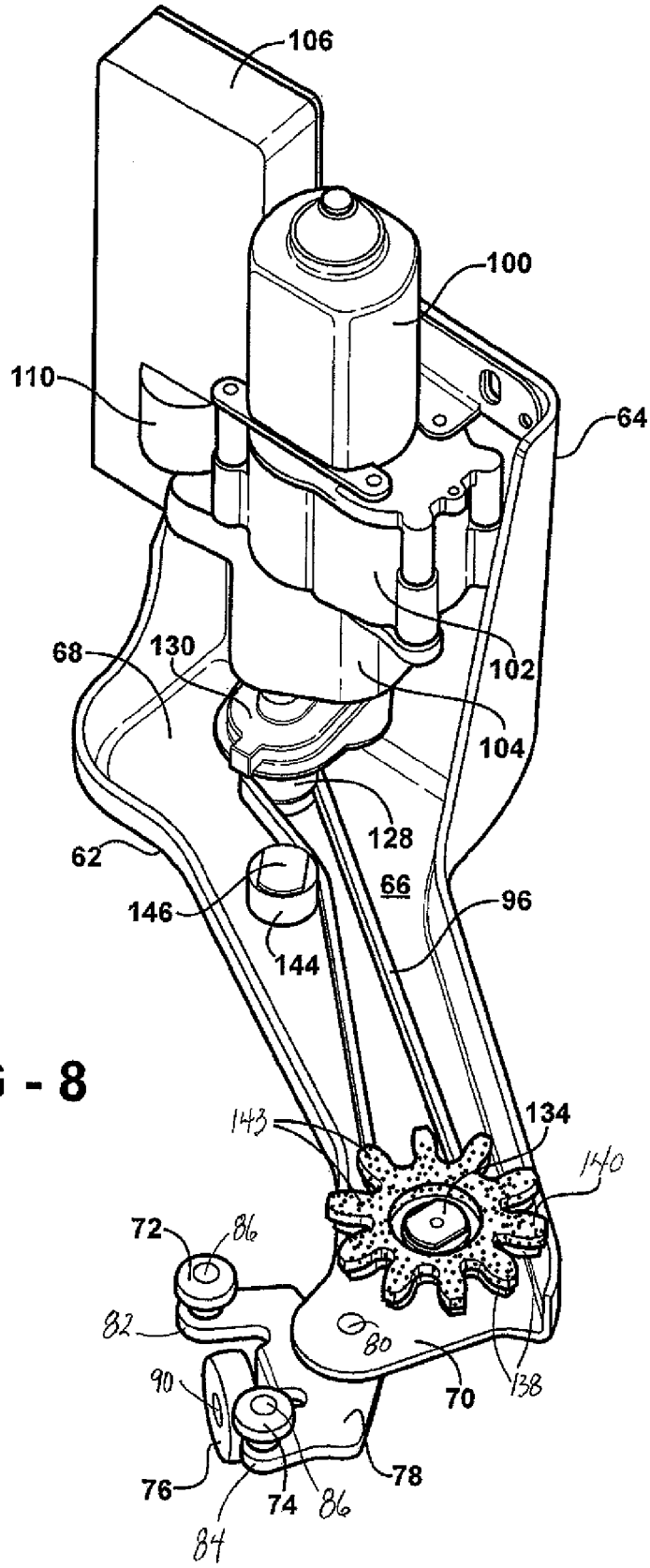
FIG. 8 is another perspective view similar to that of FIG. 7 illustrating the hinge-mounted power drive mechanism.

An output shaft 120 extending axially from the clutch 104 includes a second spur gear 122 fixed thereto for transmitting drive torque to a third spur gear 124. The third spur gear 124 is journally supported by a vertically extending post 126 mounted to the horizontal portion 66 of the lower hinge member 62 at the proximal end 68 thereof. A toothed drive pulley 128 is also journally supported by the post 126 below the third spur gear 124 and secured to the third spur gear 124 such that rotation of the third spur gear 124 by the second spur gear 122 causes the drive pulley 128 to rotate. As seen in FIGS. 6 and 8, a housing 130 encloses the second 122 and third 124 spur gears.

Figure 9:
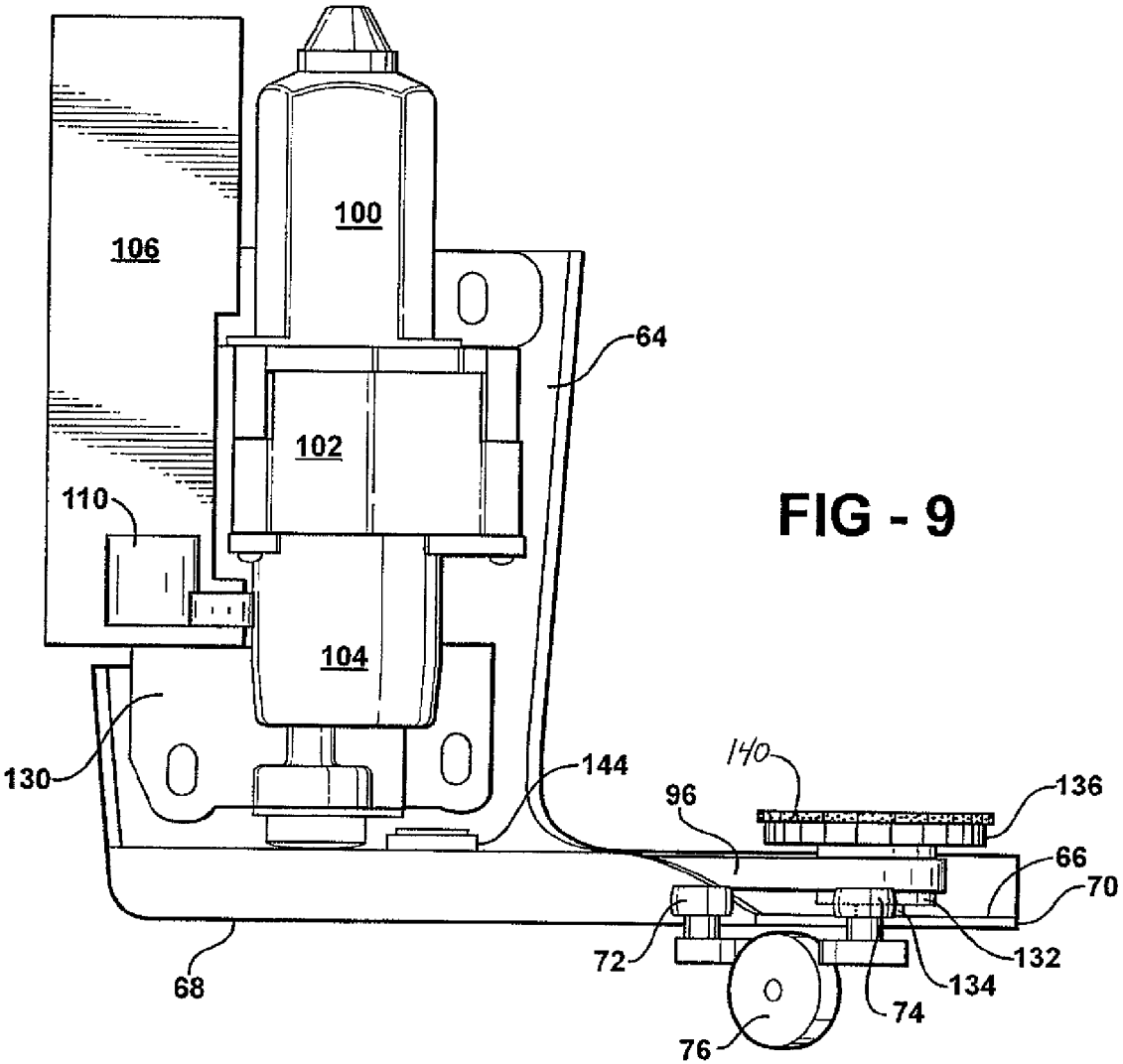
FIG. 9 is a side view of the hinge-mounted power drive mechanism.

Referring to FIG. 9, the drive unit 98 includes a toothed driven pulley 132 rotatably coupled to a vertically extending post 134 mounted to the horizontal portion 66 of the lower hinge member 62 at the distal end 70 thereof. A pinion gear 136 is also rotatably coupled to the post 134 above the driven pulley 132 and secured thereto such that rotation of the driven pulley 132 causes the pinion gear 136 to rotate. The pinion gear 136 includes a plurality of drive teeth 138 which meshingly engage the rack teeth 50, as shown in FIG. 4. As such, when the pinion gear 136 rotates, the side door 24 is moved forward and rearward relative to the vehicle body 12. Alternatively, the pinion gear 136 rotates when the side door 24 is manually moved forward and rearward relative to the vehicle body 12. A dampener shadow gear 140, shown in FIGS. 7 through 9, is secured to an upper surface 142 of the pinion gear 136, shown in FIG. 7, for preventing backlash between the rack teeth 50 and the pinion gear 136 when the side door 24 is moved manually, thereby preventing rattling. More specifically, the shadow gear 140 includes a plurality of teeth 143 which are slightly larger in dimension than the drive teeth 138 of the pinion gear 136 such that the shadow gear teeth 143 contact the rack teeth 50 first, cushioning the impact. The shadow gear teeth 143 compress and the load is then taken by the drive teeth 138 of the pinion gear 136. It will be appreciated that the shadow gear 140 may be formed of a foam or elastomer material, and may be secured to the upper surface 142 of the pinion gear 136 by over-molding, an adhesive, mechanical fasteners, or the like.

The belt 96 can be any suitable belt including rubber belts with Kevlar, steel or other reinforcements and preferably is a reinforced toothed belt which can carry relatively large tensile loads and which is not generally subject to stretching. Referring to FIG. 7, the belt 96 extends around the drive pulley 128 and the driven pulley 132 for transferring drive torque therebetween. The length of the belt 96 is selected to provide a predetermined amount of slack that is taken up by an idler pulley 144 to set the tension in the belt 96. The idler pulley 144 is journally supported by a vertically extending post 146 mounted to the horizontal portion 66 of the lower hinge member 62 between the proximal 68 and distal 70 ends.

A belt cover 148 extends between the housing 130 and the distal end 70 of the horizontal portion 66 of the lower hinge member 62 covering the belt 96 and pinion gear 136, as shown in FIG. 6. The belt cover 148 protects the belt 96 from contact with dirt and grime that typically falls from the shoes of passengers as they enter and exit the vehicle 10.

Preferably, the power unit 94, belt 96, and drive unit 98 cooperate to provide the pinion gear 136 with sufficient drive torque to enable the side door 24 to operate while the vehicle 10 is on 20% fore and aft grades with an average velocity of approximately 190.5 mm/sec. The clutch 104 is preferably an electromagnetic clutch which is operable between a disengaged position wherein the transmission of drive torque between the motor 100 and pinion gear 136 is inhibited, and an engaged position wherein the transmission of drive torque between the motor 100 and pinion gear 136 is permitted. Preferably, the clutch 104 is normally maintained in the disengaged position which prevents the pinion gear 136 from back-driving the motor 100 when the side door 24 is manually moved between the open and closed positions. Configuration in this manner permits the side door 24 to be opened and closed manually without substantially increasing the force required to propel the side door 24 compared to a completely manual side door.

In operation, starting with the side door 24 in the closed position, when it is desired to move the side door 24 to the open position an electrical signal is sent to actuate the clutch 104 from the disengaged position to the engaged position. The motor 100 is then actuated to drive in a first direction producing drive torque which passes through the gearbox 102 and clutch 104, eventually causing the output shaft 120 and second spur gear 122 to rotate in a first direction. Rotation of the second spur gear 122 in the first direction causes the third spur gear 124 and therefore the drive pulley 128 to rotate in a second direction. Engagement between the drive pulley 128 and the belt 96 causes the belt 96 to rotate in the second direction, whereby engagement between the belt 96 and driven pulley 132 in turn causes the pinion gear 136 to rotate in the second direction. Rotation of the pinion gear 136 in the second direction, and the resulting interaction between the drive teeth 138 and rack teeth 50 moves the side door 24 rearwardly into the open position. At the same time, rotational movement within the clutch 104 rotates the idler gear 116 which in turn causes the first spur gear 112, and thus the encoder wheel 114 to rotate. The optical sensor 118 monitors the rotation of the encoder wheel 114 to determine the position and velocity of the side door 24.

To close the side door 24 an electrical signal is sent to actuate the clutch 104 from the disengaged position to the engaged position. The motor 100 is then actuated to drive in a second direction producing drive torque which passes through the gearbox 102 and clutch 104, eventually causing the output shaft 120 and second spur gear 122 to rotate in the second direction. Rotation of the second spur gear 122 in the second direction causes the third spur gear 124 and therefore the drive pulley 128 to rotate in the first direction. Engagement between the drive pulley 128 and the belt 96 causes the belt 96 to rotate in the first direction, whereby engagement between the belt 96 and driven pulley 132 in turn causes the pinion gear 136 to rotate in the first direction. Rotation of the pinion gear 136 in the first direction, and the resulting interaction between the drive teeth 138 and rack teeth 50 moves the side door 24 forwardly into the closed position. At the same time, rotational movement within the clutch 104 rotates the idler gear 116 which in turn causes the first spur gear 112, and thus the encoder wheel 114 to rotate. The optical sensor 118 monitors the rotation of the encoder wheel 114 to determine the position and velocity of the side door 24.

Alternatively, the side door 24 can be moved between the open and closed positions manually. Again, starting with the side door 24 in the closed position, when it is desired to move the side door 24 to the open position no electrical signal is sent to actuate the clutch 104, which therefore remains in the disengaged position. With the clutch 104 in the disengaged position the side door 24 can be manually moved rearwardly into the open position. As the side door 24 moves rearwardly the interaction between the rack teeth 50 and the drive teeth 138 cause the pinion gear 136 and therefore the driven pulley 132 to rotate in the second direction. Engagement between the driven pulley 132 and belt 96 causes the belt 96 to rotate in the second direction, whereby engagement between the belt 96 and drive pulley 128 in turn causes the third spur gear 124 to rotate in the second direction. Rotation of the third spur gear 124 in the second direction causes the second spur gear 122 and output shaft 120 of the clutch 104 to rotate in the first direction. Rotational movement within the clutch 104 rotates the idler gear 116 which in turn causes the first spur gear 112, and thus the encoder wheel 114 to rotate. At the same time, the optical sensor 118 monitors the rotation of the encoder wheel 114 to determine the position and velocity of the side door 24.

To close the side door 24 manually, again no electrical signal is sent to actuate the clutch 104, which therefore remains in the disengaged position. With the clutch 104 in the disengaged position the side door 24 can be manually moved forwardly into the closed position. As the side door 24 moves forwardly the interaction between the rack teeth 50 and the drive teeth 138 cause the pinion gear 136 and therefore the driven pulley 132 to rotate in the first direction. Engagement between the driven pulley 132 and belt 96 causes the belt 96 to rotate in the first direction, whereby engagement between the belt 96 and drive pulley 128 in turn causes the third spur gear 124 to rotate in the first direction. Rotation of the third spur gear 124 in the first direction causes the second spur gear 122 and output shaft 120 of the clutch 104 to rotate in the second direction. Rotational movement within the clutch 104 rotates the idler gear 116 which in turn causes the first spur gear 112, and thus the encoder wheel 114 to rotate. At the same time, the optical sensor 118 monitors the rotation of the encoder wheel 114 to determine the position and velocity of the side door 24.

The invention has been described in an illustrative manner, and it is to be understood that the terminology, which has been used, is intended to be in the nature of words of description rather than of limitation. Many modifications and variations of the present invention are possible in light of the above teachings. It is, therefore, to be understood that within the scope of the appended claims, the invention may be practiced other than as specifically described.

What is claimed is:

1. A power door drive system for moving a sliding side door on a vehicle body having an aperture between an open position wherein the side door substantially clears the aperture and a closed position wherein the side door substantially covers the aperture, said power door drive system comprising:

a guide track adapted to be mounted to the vehicle body adjacent the aperture and extending therealong, said guide track including a channel portion and a rack portion, said rack portion having a plurality of rack teeth disposed therealong;

a hinge member having a proximal end adapted to be mounted to the side door and an opposite distal end;

a plurality of guide rollers operatively coupled to said distal end of said hinge member, said plurality of guide rollers rollingly engaging said channel portion of said guide track;

a power drive mechanism mounted to said hinge member, said power drive mechanism including a reversible motor fixedly mounted to said proximal end of said hinge member, a spur gear, and a drive pulley, said spur gear and said drive pulley are journally supported by a first post, said spur gear operably coupled to said reversible motor such that actuation of said reversible motor produces a drive torque to drive said spur gear in order to rotate said drive pulley, said power drive mechanism including a pinion gear and a driven pulley said pinion gear and said driven pulley are rotatably coupled to second post, said pinion gear having a plurality of drive teeth meshingly engaging said plurality of rack teeth, and said power drive mechanism including an endless belt extending around said drive pulley and said driven pulley for transferring said drive torque from said motor to said pinion gear thereby driving the sliding door between the open and closed positions; and a dampener shadow gear fixedly secured directly to an upper surface of said pinion gear for engaging said plurality of rack teeth and preventing backlash between said rack teeth and said pinion gear.

2. A power door drive system as set forth in claim 1 wherein said dampener shadow gear includes a plurality of teeth which are larger in dimension than said plurality of drive teeth of said pinion gear.

3. A power door drive system as set forth in claim 2 wherein said channel portion of said guide track includes a vertical guide surface and first and second horizontal guide surfaces, said vertical and horizontal guide surfaces cooperating with said plurality of rollers to position said hinge member in both a vertical and horizontal direction as the sliding door is moved between the open and closed positions.

4. A power door drive system as set forth in claim 3 including an encoder wheel operatively coupled to said pinion gear and an optical sensor for reading, said encoder wheel as said encoder wheel rotates to determine a position and a velocity of the sliding door as the sliding door moves between the open and closed positions.

5. A power door drive system as set forth in claim 4 including an idler pulley rotatably mounted to said hinge member between said drive pulley and said driven pulley for engaging and tensioning said belt therebetween.

6. A power door drive system as set forth in claim 5 wherein said hinge member includes a horizontal portion extending between said proximal end and said distal end and a vertical portion extending upwardly from said proximal end, said reversible motor is mounted to said vertical portion and said spur gear and pinion gear are mounted to said horizontal portion.

7. A power door drive system as set forth in claim 6 including an articulating bracket pivotally coupled to said distal end of said hinge member, said guide rollers rotatably mounted to said articulating bracket for guiding said hinge member along said channel portion.

8. A power door drive system as set forth in claim 7 including a clutch operatively coupled between said reversible motor and said spur gear for operatively coupling said motor and said pinion gear in an engaged position and decoupling said motor and said pinion gear in a disengaged position.

9. A power door drive system as set forth in claim 8 including an idler gear operatively coupled between said encoder wheel and said spur gear through said clutch for rotating said encoder wheel during travel of said pinion gear along said rack portion.

10. A power door drive system for moving a sliding side door on a vehicle body having an aperture between an open position wherein the side door substantially clears the aperture and a closed position wherein the side door substantially covers the aperture, said power door drive system comprising:

a guide track adapted to be mounted to the vehicle body adjacent the aperture and extending therealong, said guide track including a channel portion and a rack portion, said rack portion having a plurality of rack teeth disposed therealong;

a hinge member having a proximal end adapted to be mounted to the side door and an opposite distal end;

an articulating bracket pivotally coupled to said distal end of said hinge member;

a plurality of guide rollers rotatably coupled to said articulating bracket, said plurality of guide rollers rollingly engaging said channel portion of said guide track for guiding said hinge member along said channel portion; and a power drive mechanism mounted to said hinge member, said power drive mechanism including a reversible motor fixedly mounted to said proximal end of said hinge member, a spur gear, and a drive pulley, said spur gear and said drive pulley are journally supported by a first post, said spur gear operably coupled to said reversible motor such that actuation of said reversible motor produces a drive torque to drive said spur gear in order to rotate said drive pulley, said power drive mechanism including a pinion gear and a driven pulley, said pinion gear and said driven pulley are rotatably coupled to second post, said pinion gear having a plurality of drive teeth meshingly engaging said plurality of rack teeth, and said power drive mechanism including an endless belt extending around said drive pulley and said driven pulley for transferring said drive torque from said motor to said pinion gear thereby driving the sliding door between the open and closed positions.

11. A power door drive system as set forth in claim 10 wherein said plurality of guide rollers is rotatably coupled directly to said articulating bracket.

12. A power door drive system as set forth in claim 11 including a dampener shadow gear fixedly secured directly to an upper surface of said pinion gear for engaging said plurality of rack teeth and preventing backlash between said rack teeth and said pinion gear.

13. A power door drive system for moving a sliding side door on a vehicle body having an aperture between an open position wherein the side door substantially clears the aperture and a closed position wherein the side door substantially covers the aperture, said power door drive system comprising:

a guide track adapted to be mounted to the vehicle body adjacent the aperture and extending therealong, said guide track including a channel portion and a rack portion, said rack portion having a plurality of rack teeth disposed therealong;

a hinge member having a proximal end adapted to be mounted to the side door and an opposite distal end;

a plurality of guide rollers operatively coupled to said distal end of said hinge member, said plurality of guide rollers rollingly engaging said channel portion of said guide track;

a power unit including a motor mounted to said hinge member, a spur gear operably coupled to said motor and journally supported by a post, and a drive pulley journally supported by said post and rotatable with said spur gear, said motor operable for producing a drive torque to drive said spur gear in order to rotate said drive pulley;

a drive unit including a driven pulley and a pinion gear, said driven pulley and said pinion gear are rotatably coupled to a post, said pinion gear having a plurality of drive teeth meshingly engaging said plurality of rack teeth; and an endless belt extending around said drive pulley and said driven pulley for transferring said drive torque from said motor to said pinion gear thereby driving the sliding door between the open and closed positions.

14. A power door drive system as set forth in claim 13 including a clutch operatively coupled between said motor and said spur gear for operatively coupling said motor and said pinion gear in an engaged position and decoupling said motor and, said pinion gear in a disengaged position.

15. A power door drive system as set forth in claim 14 including an encoder wheel operatively coupled to said pinion gear and an optical sensor for reading said encoder wheel as said encoder wheel rotates to determine a position and a velocity of the sliding door as the sliding door moves between the open and closed positions.

16. A power door drive system as set forth in claim 15 including an idler gear operatively coupled between said encoder wheel and said spur gear through said clutch for rotating said encoder wheel during travel of said pinion gear along said rack portion.

17. A power door drive system as set forth in claim 13 including an idler pulley rotatably mounted to said hinge member between said drive pulley and said driven pulley for engaging and tensioning said belt therebetween.

* * * * *